United States Patent [19]

Engeler et al.

[11] 4,084,256

[45] Apr. 11, 1978

[54] SAMPLED DATA ANALOG MULTIPLIER APPARATUS

[75] Inventors: William E. Engeler, Scotia; Howard S. Goldberg, Schenectady, both of N.Y.

[73] Assignee: General Electric Company, Schenectady, N.Y.

[21] Appl. No.: 751,122

[22] Filed: Dec. 16, 1976

[51] Int. Cl.[2] ..... G06G 7/16

[52] U.S. Cl. ..... 364/862; 307/221 D; 357/24; 364/841

[58] Field of Search ..... 235/194, 193; 307/221 D, 229; 328/160, 167; 357/24

[56] References Cited

U.S. PATENT DOCUMENTS

| | | | |
|---|---|---|---|
| 3,809,923 | 5/1974 | Esser | 307/221 D |
| 3,819,958 | 6/1974 | Gosney | 307/221 D X |
| 3,877,056 | 4/1975 | Bailey | 307/221 D X |
| 3,947,705 | 3/1976 | Emmons | 307/221 D X |
| 3,956,624 | 5/1976 | Audaire et al. | 235/194 |

*Primary Examiner*—Joseph F. Ruggiero
*Attorney, Agent, or Firm*—Julius J. Zaskalicky; Joseph T. Cohen; Jerome C. Squillaro

[57] ABSTRACT

An analog multiplier for multiplying each sample of an input sequence of samples of an analog signal by a respective multiplying coefficient of a series of coefficients is provided. The multiplier includes a plurality of charge storage cells, each cell including a first and a second storage region. Means are provided for introducing into each of the charge storage cells a respective quantity of charge representing a respective sample of a signal. The quantity of charge is divided between the first and second storage regions of a cell in proportion to the ratio of the width of the first storage region to width of the second storage region thereof. Means are provided for altering the charge in each of the second storage regions of each of the cells. Means are provided for recovering from each of the cells a respective resultant quantity of charge stored therein, each resultant quantity being the sum of the initially introduced charge in the first storage region and the altered charge in second storage region of a respective cell. Thus, each resultant quantity of charge represents the product of an analog input sample multiplied by a respective multiplying coefficient corresponding to the relative values of the widths of the first and second storage regions of a cell.

15 Claims, 9 Drawing Figures

SAMPLED DATA ANALOG MULTIPLIER APPARATUS

SAMPLED DATA APPARATUS

The present invention relates in general to sampled data apparatus and in particular to analog multipliers for providing an output sequence of samples in which each sample represents a product of a respective sample of an analog input and a respective multiplying factor.

Such multipliers have been implemented heretofore by a system utilizing a multiplying digital-to-analog converter. In this system the multiplying factors are stored as digital reference words in a read-only memory which controls the read out of the converter. Such prior art multipliers are complex, costly and difficult to integrate on chip with MOS charge transfer devices.

Accordingly, an object of the present invention is to provide analog multipliers which are relatively simple and inexpensive.

Another object of the present invention is to provide an analog multiplier of the character described which is capable of being integrated on chip with MOS charge transfer devices.

Another object of the present invention is to provide a multiplier which provides an output in the form of quantities of charge which can be directly applied to other charge transfer devices without requiring any additional interfacing circuits.

Another object of the present invention is to provide a multiplier which provides output in the form of voltage signals.

A further object of the present invention is to provide an analog multiplier which stores the analog multiplying factor used in the operation thereof.

In carrying out the invention in one illustrative embodiment thereof, there is provided a substrate of semiconductor material in which is located a plurality of charge storage cells adjacent a major surface thereof. Each cell includes a first charge storage region and a second charge storage region. A plurality of first storage electrodes are provided, each electrode associated with a respective cell and each electrode includng a first part and a second part. Each first part insulatingly overlies and is coextensive with a respective first charge storage region and each second part insulatingly overlies and is coextensive with a respective second charge storage region. The ratio of the width of the first charge storage region to the width of the second storage region of each of the cells is set to a respective predetermined value. Means are provided for introducing into each of the charge storage cells a respective quantity of charge representing a respective sample of a signal. The quantity of charge is divided between the first and second storage regions of a cell in proportion to the ratio of the width of the first storage region to width of the second storage region thereof. Means are provided for altering the charge in each of the second storage regions of each of the cells. Means are provided for recovering from each of the cells a respective resultant quantity of charge stored therein, each resultant quantity being the sum of the initially introduced charge in the first storage region and the altered charge in the second storage region of a respective cell.

The novel features which are believed to be characteristic of the present invention are set forth with particularity in the appended claims.

The invention itself, both as to its organization and method of operation, together with further objects and advantages thereof, may best be understood by reference to the following description taken in connection with the accompanying drawings wherein.

Figure 1:
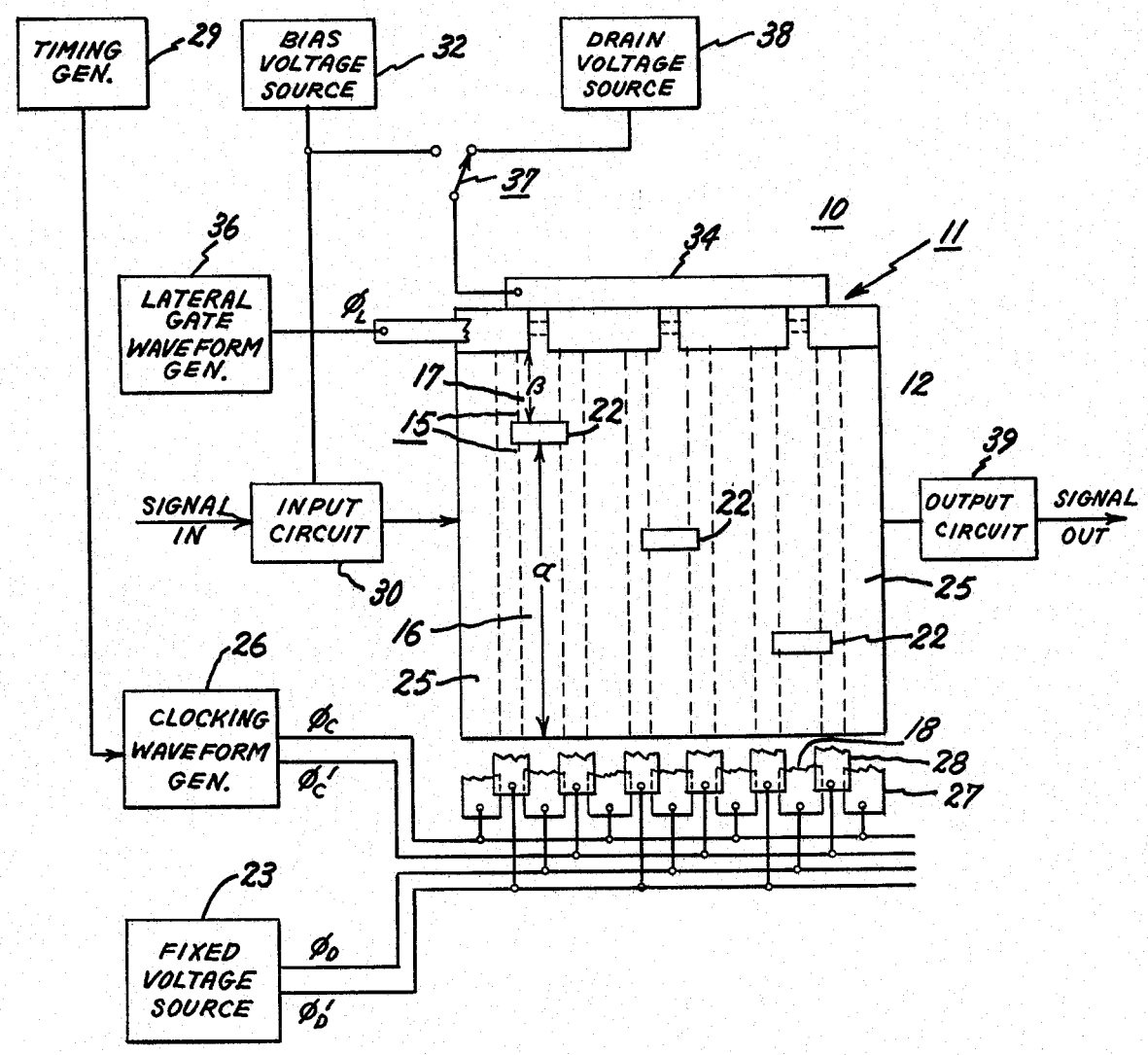
FIG. 1 is a diagram of one embodiment of an analog multiplier in accordance with the present invention.

Reference is made to FIG. 1 which shows an analog multiplier apparatus 10 for generating packets or quantities of charge corresponding to samples of a time varying analog signal, for performing multiplying operations on each of the packets, and thereafter recovering each of the resultant packets to provide an output, either in the form of charge packets or voltage samples, which represents the product of the initial samples multiplied by respective multiplying factors. The apparatus 10 comprises a shift register 11 including a plurality of charge storage and transfer stages formed on the common semi-conductor substrate 12, only three stages of which are shown for reasons of simplicity in describing the apparatus and explaining the operation thereof. Each of the stages include a charge storage cell 15 having a first charge storage region 16 and a second charge storage region 17. Each of the charge storage regions 16 and 17 have the same length as measured along the direction of charge transfer in the shift register from left to right and are disposed side by side in the width direction of the shift register. A plurality of first storage electrodes 18 are provided, each electrode being associated with a respective cell 15. Each electrode 18 includes a first part which insulatingly overlies and is coextensive with a first charge storage region 16 and a second part insulatingly overlying and coextensive with a respective second charge storage region 17 of a respective cell. The width of the first part of electrode 18 and the first charge storage region lying thereunder is designated $\alpha$ and the width of the second part and the second charge storage region 17 lying thereunder is designated $\beta$. The sum of the width of the first and second parts of each of the electrodes is the same. In accordance with a feature of the present invention, the ratio $(\alpha/\beta)$ of the width of the first charge storage region 16 to the width of the second charge storage region 17 of each of the cells is set to a respective predetermined value to provide a weighting coefficient or a multiplying factor, as will be explained in more detail below. The separation of the first and second storage regions of each of the cells is provided in this embodiment by a channel stop in the form of a thick oxide block 22 underlying the electrode 18. Alternative methods of providing a channel stop include the use of a more heavily concentrated bulk impurity region or the use of an appropriately biased overlying electrode. The frist and second storage regions 16 and 17 are established by applying a fixed voltage $\phi_D$ from source 23 to the electrodes 18. Each of stages of shift register 11 includes a third storage region 25 extending along the entire width of the shift register 11 and spaced from the first and second storage regions thereof. A plurality of third storage electrodes 27 are provided, each insulatingly overlying and coextensive with a respective third storage region 25. The third storage regions are established by applying a clocking voltage 100 $_C$ from source 26 to the electrodes 27. Transfer gate electrodes 28 are provided insulatingly overlying adjacent the first and third electrodes and utilized for directionally transferring of charge from stage to stage of the shift register, as will be explained in more detail in connection with voltage wave form diagrams of FIG. 7. An input circuit 30 is provided for generating packets of charge representing samples of a time varying analog signal. Such input circuits are well known in the art, one of which is described in connection with FIGS. 8A, 8B and 8C in patent application Ser. No. 609,415, now U.S. Pat. No. 4,032,867 filed Sept. 2, 1975 assigned to the assignee of the present invention, and incorporated herein by reference thereto. This particular circuit is referred to as a "fill and spill" circuit. Of course, other input circuits may be utilized. Bias voltage source 32 connected to the input circuit 30, when used, provides a fixed bias charge component to each input packet of charge to accommodate both negative as well as positive signal samples. When the bias source is used, if a signal sample is positive, a corresponding signal related charge is added to the fixed bias charge to constitute the input packet, and conversely if the signal sample is negative a corresponding signal related charge is subtracted from the fixed bias charge to constitute the input packet. Thus, the packet of charge applied to the input of the shift register is the algebraic sum of the fixed bias charge and the signal related charge. Each of the packets of charge are introduced into a respective one of the cells 15 by serially clocking the packets from stage to stage until they are situated in the desired stage or cell. In the process of clocking the packets of charge from stage to stage each packet alternately splits and recombines as it is clocked from stage to stage to its desired stage. After each of the packets of charge have been serially clocked into the desired cells the clocking is stopped. Upon transfer into the cells each packet of quantity of charge divides between the first and second storage regions of each of the cells 15 in proportion to the ratio of the width of the first storage region 16 to the width of the second storage region 17. At this point in the operation of the apparatus the charge in each of the second storage regions 17 of each of the cells is altered. Means to accomplish this end are provided by a drain 34 in the form of a region of conductivity type opposite to the conductivity type of the substrate and a lateral transfer gate electrode 35 insulatingly overlying the substrate. The lateral transfer gate electrode 35 is under the control of the lateral gate waveform generator 36 which provides a voltage waveform which either allows the transfer charge between the second storage regions 17 and the drain 34 or inhibits the transfer of charge between second storage regions 17 and drain 34. Both the lateral gate waveform generator 36 and the clocking waveform generator 26 are under the control of the timing generator 29. The drain 34 is connected through switch 37 to either voltage source 38 which provides a voltage to the drain 34 to enable emptying of the second storage regions 17 when the lateral gate electrode 35 is turned on, or to bias voltage source 32 which provides a voltage on drain 34 establishing by equilibration quantities of charge in the second storage regions equal to the components of bias charge included therein, i.e., the signal related charge components of charge included in the second storage regions are drained from the second storage regions. Thus, initially the packets of charge are clocked into the desired stages after which the clocking is stopped. The lateral gate 35 is opened allowing charge interchange between the second storage regions 75 and the drain 34 to establish new levels of charge in the second storage regions. Thereafter, the lateral gate 35 is closed and clocking again initiated to recover packets of charge altered by the operation.

In one mode of operation, with zero bias charge applied to the input of the shift register and the drain 34 connected to the drain voltage source 38, the charge of the $n^{th}$ input sample may be denoted as $$Q_n^{in} = Q_n^{sig} \tag{1}$$

wherein $Q_n^{sig}$ is the signal related charge.

After each of the packets of charge have been clocked to its respecting processing stage, the lateral gate 35 is opened and the charges in the second storage regions are drained. Thus, the resultant packet of charge in the $n^{th}$ stage is represented as follows:

$$Q_n^{out} = Q_n^{sig} \times \alpha_n, \tag{2}$$

$Q_n^{out}$ is equal to the input signal related charge multiplied by a fixed multiplying coefficient $\alpha_n$, where $\alpha_n$ is the width of the first storage region of the $n^{th}$ cell, and is recovered by serially clocking the resultant packets out of the shift register as pointed out above.

In another mode of operation the drain 34 is connected to bias voltage source 32 through switch 37 and the voltage of bias voltage source 32 is set to provide a fixed bias charge $Q_{bias}$ at the input of the shift register. The charge of the $n^{th}$ input sample may be represented as follows:

$$Q_n^{in} = Q_n^{sig} + Q_{bias}. \tag{3}$$

After each of the packets of charge have been clocked to its respective processing state, the lateral gate 35 is opened and the charges in the second storage regions 17 equilibrate to $Q_{bias} \times \beta_n$, where $\beta_n$ is the width of the second storage region of the $n^{th}$ cell, as the drain 34 is provided with the same bias potential as the input circuit 30. Thus, the resultant packet of charge in the $n^{th}$ stage is represented as follows:

$$Q_n^{out} = [Q_n^{sig} + Q_{bias}] \times \alpha_n + Q_{bias} \times \beta_n \tag{4}$$

As $$Q_{bias} = Q_{bias} \times \alpha_n + Q_{bias} \times \beta_n, Q_n^{out} = Q_n^{sig} \times \alpha_n + Q_{bias}. \tag{5}$$

The output charge given by equation 5 is thus the same as the input charge given by equation 3 except that each of the signal charge samples $Q_n^{sig}$ is multiplied by its corresponding multiplicative coefficient $\alpha_n$. This is the desired result. $Q_n^{out}$ is recovered by serially clocking the resultant packets out of the shift register as pointed out above.

The signal obtained at the output of the apparatus is in the form of charge and may be utilized and applied to other devices which may be located on the same substrate of semi-conductor material and may, for example, include a transversal filter. The signal may also be obtained as voltage in which case the packets of charge are converted into voltage samples. The packets of charge may be converted into voltage samples by utilization of any of a number of suitable circuits one of which is disclosed and described in connection with the embodiment of FIG. 9 in which a diffused region of opposite conductivity type is provided at the output of the apparatus and is suitably precharged and floated. A sample of charge is transferred to the floated diffused region causing a change in potential thereof which is representative of the quantity of charge transferred to the diffused region.

Reference is now made to FIGS. 2 through 6 which show one physical implementation of the analog multiplier apparatus 10 of FIG. 1 in accordance with the present invention. The shift register 11 is formed on a semiconductor substrate 12 of N-type conductivity which has a channel portion 13 of uniform width adjacent a major surface 14 of the substrate. Typically, the substrate 12 may be silicon semiconductor material of 4 ohm centimeter resistivity. Overlying the major surface 14 of the substrate is a thick insulating member 40 of silicon dioxide having a pair of thin portions 41 and 42. The first thin portion 42 is of generally rectangular outline and lies in registry with the channel portion 13 of the substrate in which the first storage regions 16, the second storage regions 17 and the third storage regions 25 described in FIG. 1 are formed. A second thin portion 42 also generally rectangular outline is provided parallel to the first thin portion 41 and separated therefrom by intermediate ridge 43 of thick silicon dioxide. Outer ridges of thick portions 44 and 45 of insulating material provide the outer boundaries, respectively, for the first thin portion 41 and for the second thin portion 42 of insulating material. A plurality of slots 48 is provided in the thick ridge portion 43. The slots 48 are orthogonal to the length direction of the thin portion 41 and extend to a sufficient depth to provide thin sections of insulation overlying the substrate 12 substantially equal in thickness to the first thin insulating portions 41. A plurality of electrodes 18 are provided on the insulating member 40 overlying the thin portion 41 and orthogonal to the length thereof. Each of the electrodes 18 is of uniform length in the direction of the length of the semiconductor channel underlying thin portion 41 and each of the electrodes 18 extends across the lower thick portion 44, the first thin portion 41 including the thick insulating block 22, which will be described below, and over the intermediate ridge 43 in the vicinity of a respective slot 48 and terminates in a common conductor 50 overlying the second thin portion 42 of insulation. The common conductor 50 extends along the length of the thin portion 42 of insulating material. A longitudinal drain region 34 is formed (underlying the second thin portion 42 of insulating material) in the semiconductor substrate. This can be conveniently done by ion implantation and diffusion of opposite conductivity type impurities in the substrate using the longitudinal electrode 50 and the thick oxide boundary portion 45 as an ion implantation mask. Thus, adjacent edges of the common conductor 50 and the drain 34 are in registry. A terminal 52 is connected to the longitudinal diffused region 34. Rectangular gaps 54 are provided in portions of the electrodes 18 lying in the base of the slots 48. Overlying the first thin portion 41 of insulation and underlying each electrode 18 is provided a thick insulating block 22 having a length dimension in the direction of charge transfer in the semiconductor channel underlying the portion 41 which extends slightly beyond the leading and lagging edges of an electrode 18 and has a width dimension of a small value. The block 22 is utilized to separate and define a first and second storage regions in the substrate underlying electrode 18. The positioning of the block 22 in the width direction sets the ratio of widths the first and second storage regions, as pointed out in connection with FIG. 1.

A plurality of third electrodes 27 are provided on the insulating member 40 overlying the thin portion 41 and orthogonal to the length thereof. Each of the electrodes is of uniform length in the direction of the length of the thin portion and is substantially equal to the length of each of the electrodes 18. Each of the third electrodes 27 is spaced between adjacent electrodes of first electrodes 18 and each extends from a position overlying the lower boundary portion 44 of insulating member 40 completely over the thin portion 41 and on to a portion of the intermediate ridge 43. An insulating layer 60 is provided over the first electrodes 18 and the third electrodes 27, completely covering the electrodes 18 and 27. A plurality of transfer electrodes 28 are provided over the uncovered portions of thin insulating layer 41 and portions of the insulating layer 60. Each of the transfer electrodes 28 is insulatingly spaced between and overlying a portion of a respective pair of adjacent first electrodes 18 and third electrodes 27. Each of the transfer electrodes 28 is of substantially uniform length in the direction of the length of the thin portion 41 and extends entirely over the thin portion 41 of insulating member 40 as well as the bordering thick insulating portion 44 and over a small portion of intermediate ridge portion 43. A lateral transfer gate electrode 35 or line is provided on the intermediate ridge portion and overlying the gaps 48 formed in electrodes 18. The lateral transfer gate electrode 35 completely overlies gaps 54 in the first electrode 18. The lateral transfer electrode 35 is provided with a suitable terminal 62 to enable external electrode connection to be made thereto. Thus, when a suitable gate potential is applied to the gate electrode 35 a conduction channel is formed in the underlying semiconductor substrate which enables transfer of charge from the second storage regions 17 underlying the electrodes 18 to the longitudinal drain region 34.

The first storage electrodes 18 overlying the first and second storage regions 16 and 17 of the cells 15 are designated as $\phi_D$ electrodes and are connected to a common line 64 which in turn is connected to a source of $\phi_D$ voltage. All of the third storage electrodes 27 are designated $\phi_C$ electrodes and are connected to a common line 65 which in turn is connected to a source of $\phi_C$ clocking voltage. All of the transfer electrodes 28 which overlie a leading or input edge of the first and second storage regions are designated as $\phi_D'$ electrodes and are connected to a common line 66, which in turn is connected to a source of $\phi_D'$ voltage. All of the transfer electrodes 28 which overlie a leading or input edge of a $\phi_C$ electrode 27 are designated as $\phi_C'$ electrodes and are connected to a common line 67 which in turn is connected to a source of $\phi_C'$ voltage. A conductive layer 69 of a suitable material such as gold is eutectically bonded to the lower surface of the substrate 12 to provide a substrate contact to which the ground line of the $\phi_D$, $\phi_D'$, $\phi_C$, and $\phi_C'$ sources are connected.

Figure 7:
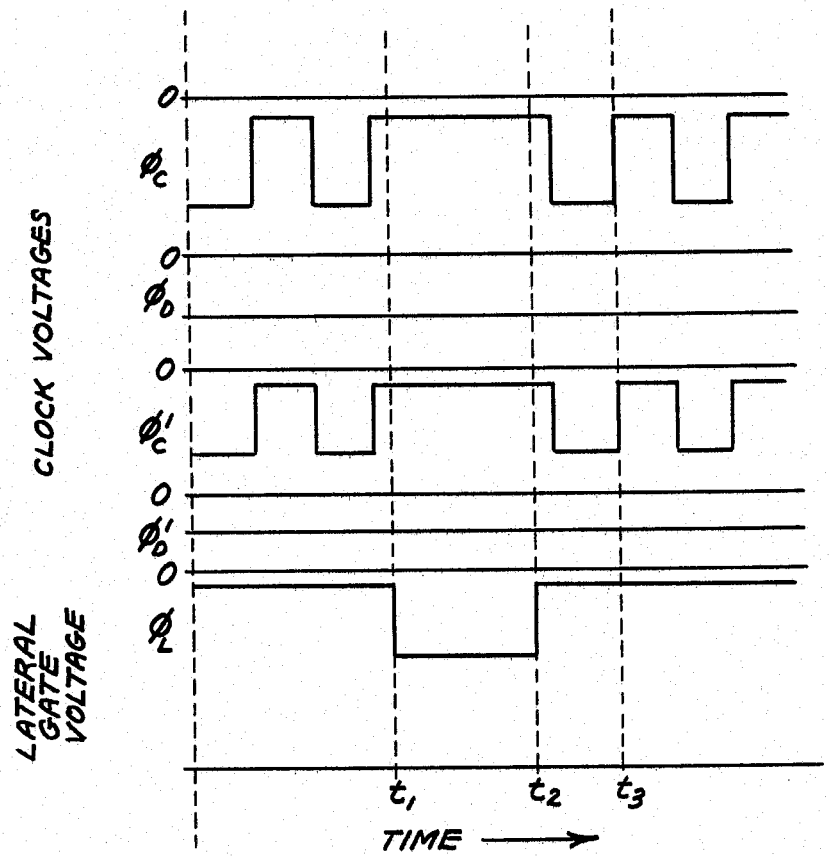
FIG. 7 shows diagrams of amplitude versus time of voltage wave forms occurring at various points in the apparatus of FIG. 1 useful for explaining the operation thereof.

The manner in which packets of charge are clocked into the shift register 11 and transferred from stage to stage along the shift register, the manner in which charge is processed in the shift register, and thereafter the manner in which charge is transferred from stage to stage out of the shift register will now be described in connection with the diagrams of FIG. 7 which shows the clocking waveforms $\phi_C$, $\phi_D$, $\phi_C'$ and $\phi_D'$ and the lateral gate waveform $\phi_L$. The voltages $\phi_C$, $\phi_C'$, $\phi_D$ and $\phi_D'$ are applied to the lines 65, 67, 64 and 66, respectively. The voltage $\phi_L$ is applied to the terminal 62. For the structure shown utilizing a silicon substrate of N-type conductivity and having a resistivity of about 4 ohm centimeters, an oxide thickness under the first and second electrodes of 1000 Angstroms and an oxide thickness under the transfer electrodes of 2000 Angstroms, typical relative values of voltage which may be used in the waveforms thereof are depicted in FIG. 7. The $\phi_C$ voltage levels are about $-6$ volts and $-28$ volts. The $\phi_C'$ voltage levels are about $-3$ volts and $-22$ volts. The $\phi_D$ voltage is a fixed voltage lying between the extreme values of the $\phi_C$ voltage and is shown as about $-15$ volts. The $\phi_D'$ voltage is a fixed voltage lying between the extreme values of the $\phi_C'$ voltage and is shown as about $-9$ volts.

During a first period of time quantities or packets of charge representing samples of analog signal are introduced into the shift register and are clocked along from stage to stage until each packet is located in the respective stage or cell in which processing is to be carried out thereon. In the graph of FIG. 7 the first period of time is represented as a period of time prior to the instant $t_1$. During this period of time clocking $\phi_C$ and $\phi_C'$ voltage waveforms, only several cycles of which are shown, are applied to the $\phi_C$ and $\phi_C'$ clocking electrodes. The packets of charge are clocked from stage to stage by cycling the voltage of the $\phi_C$ electrodes above and below the $\phi_D$ voltage on the $\phi_D$ electrodes 18 thereby causing the $\phi_C$ electrodes alternately to send charge to the $\phi_D$ electrodes and on the second half of the cycle to receive charge from the $\phi_D$ electrodes. The voltage $\phi_C'$ applied to the $\phi_C'$ transfer gating electrodes is identical in form to the $\phi_C$ voltage waveform and is alternately cycled above and below the voltage $\phi_D'$ applied to the transfer gate electrodes $\phi_D'$. The $\phi_C'$ and the $\phi_D'$ electrodes along with the voltage applied thereto causes the charge to transfer from left to right in the shift register from stage to stage. During a second period of time, represented by period $t_1$ to $t_2$ in the diagrams of FIG. 7, the packets of charge are stored or held in the $\phi_D$ storage sites, that is, in the first and second storage regions of each of the stages, with each packet being located in its respective cell. During this second period of time the lateral gate voltage $\phi_L$ goes negative to a value sufficient to turn the gate electrode 35 "ON" by lowering the surface potential underlying the gate electrode and to permit charge to transfer from the second storage regions 17 of each of the stages to the drain 34 and thus for the charge in each of the second storage regions to be altered. The alteration of the charge in the second storage regions is completed during the second period of time and the lateral gate 35 is turned OFF at the end of this period. During a third period of time the charge in each of the cells which includes the charge in the first storage region and the altered charge in the second storage region is transferred to a succeeding $\phi_C$ storage site which conveniently may be referred to as a fourth storage region thereby recovering a quantity of charge representing a charge from the first and second storage regions of a cell. This period of time is represented by the interval $t_2$ to $t_3$ representing one half of a clocking cycle. As the clocking continues, conveniently designated as a fourth period of time, resulted quantities of charge are serially transferred from stage to stage to a final stage where the resulted quantities of charge are serially removed or applied to other charge transfer apparatus, such as transversal filters and the like.

During the second period of time the charge in the second storage regions of the cell may be altered in various ways depending upon the potential applied to the drain electrode of the shift register. In one mode of operation the drain terminal 52 is connected to a potential sufficiently negative to allow complete or substantially complete drainage of the charge in the second storage regions to the drain during the lateral transfer operation. The resultant charge and hence processed samples may be represented by equation 2, as explained in connection with FIG. 1. In another mode of operation, also explained in connection with FIG. 1, the drain voltages are set equal to the bias voltage utilized for setting the fixed bias charge applied to the shift register. In this mode of operation the quantity of charge in the second storage region is altered to be equal to $\beta$ times the input bias charge, where $\beta$ is the ratio of the width of the second storage region to the sum of the widths of the first and second storage regions. Stated in other words, the charge altering means changes the charge introduced in each of the second storage regions to be equal to the respective portion of the fixed quantity of charge introduced into the second storage region.

As the charge is transferred from the lagging edge of the third storage region to the leading edge of the first and second storage regions at the same rate, the relative quantity of charge transferred to the first and second storage regions is determined by the ratio of the width of the first storage region to the width of the second storage region, and is in general independent of the planar area of the first and second storage regions. However, as in the shift register of FIG. 1 the length of the first and second storage regions in the direction of charge transfer is uniform the division of charge between the first and second storage regions is also proportional to the ratio of the planar areas of the first and second storage regions.

Figure 8:
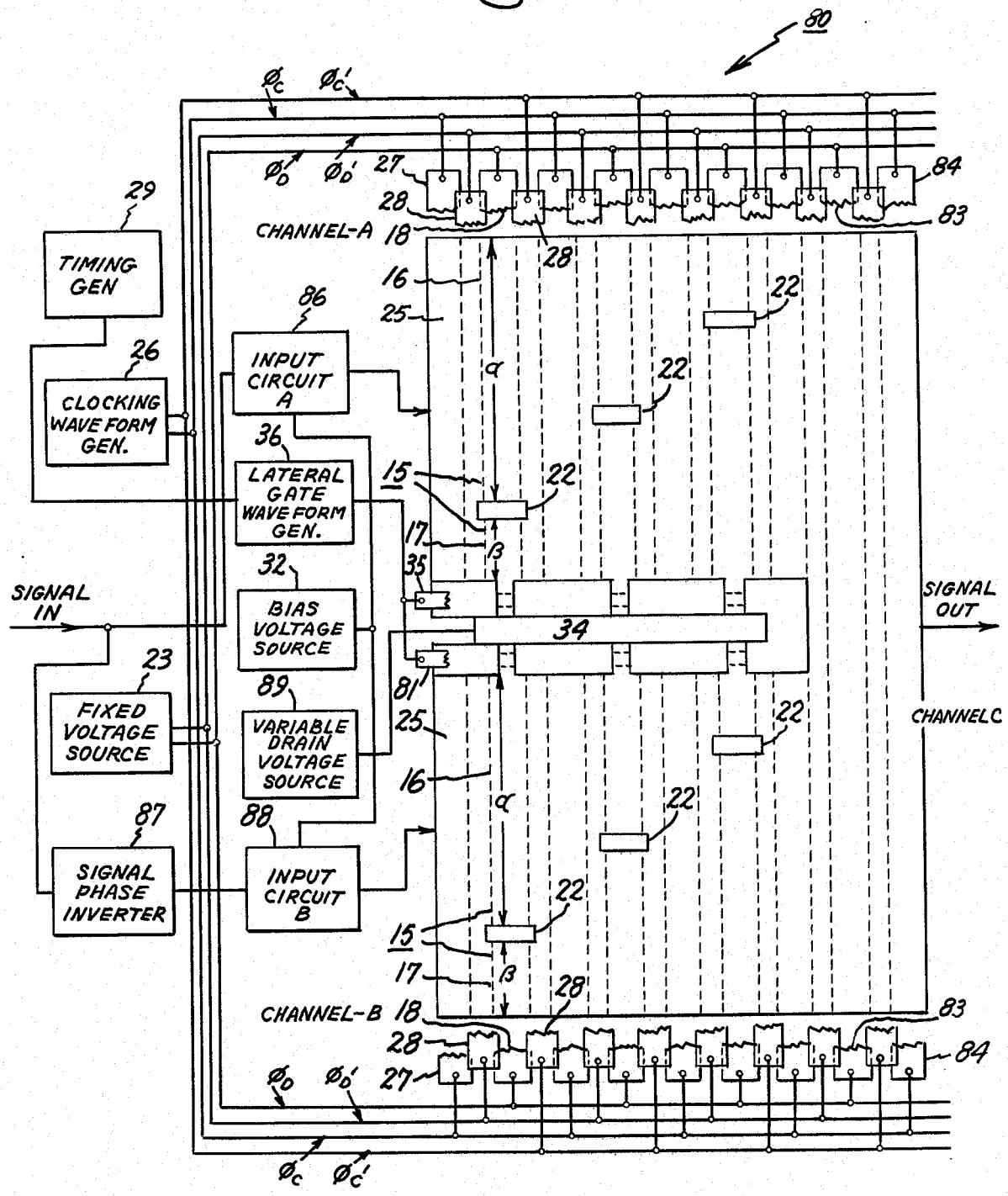
FIG. 8 shows a diagram of analog multiplier apparatus in accordance with another embodiment of the present invention.

In the analog multiplying apparatus 10 of FIG. 1, the fixed multiplying coefficients ($\alpha_n$) of each of the stages of the shift register or processor could have any positive value from zero to one while, of course, the signal could have both positive and negative values, if bias charge were used. Such analog multipliers are referred to as two quadrant multipliers. To increase the utility and application of the multiplying apparatus it is desirable that not only the signal, but also the multiplying coefficients be permitted to have negative as well as positive values. Such multipliers are referred to as four quadrant multipliers. The apparatus 80 of FIG. 8 provides four quadrant multiplication in accordance with a further feature of the present invention. The elements of the apparatus of FIG. 8 identical to the elements of the apparatus of FIG. 1 are identically designated. In this apparatus two shift registers or channels are provided, each essentially identically constituted and conveniently referred to as channels A and B. The storage electrodes 18 of channel A are conveniently referred to as first storage electrodes and storage electrodes of channel B are referred to as second storage electrodes. Channel A is identical to the shift register 11 of FIG. 1. Channel B is also identical to shift register 11 of FIG. 1 except that the lateral transfer gate 81 thereof is located to access the first storage regions 16 of the cells 15 of the channel instead of the second storage regions 17. Corresponding stages of channels A and B have the same ratio of width $\alpha$ of the first storage region 16 to width $\beta$ of the second storage region 17. Also, a common drain 34 is provided for channels A and B. The outputs of channel A and channel B are added in a combining channel C having $\phi_D$ electrodes 83 and $\phi_C$ electrodes 84 in which the output is retained as charge suitable for applying to other charge transfer structures located on the same substance, as desired, or not. Separate inputs are applied to channels A and B. An analog signal is applied to the input circuit 86 of channel A. The analog signal inverted in phase by phase inverter 87 is applied to the input circuit 88 of channel B. The same bias voltage is applied to the input circuits 86 and 88 from bias voltage source 32. Thus, the packet of the charge $Q_n^A$, the $n^{th}$ sample in a sequence of N samples, applied to to the input of the channel A is the algebraic sum of a fixed quantity of bias charge $Q_{bias}$ and the signal related charge $Q_n^{sig}$, and the packet of charge $Q_n^B$ applied to the input of the channel B is the algebraic sum of the same fixed quantity of bias charge $Q_{bias}$ applied to channel A and the inverse of the signal related charge $-Q_n^{sig}$. Thus, $$Q_n^A = Q_n^{Sig} + Q_{bias}, \tag{6}$$

and $$Q_n^B = -Q_n^{Sig} + Q_{bias}. \tag{7}$$

Figure 2:
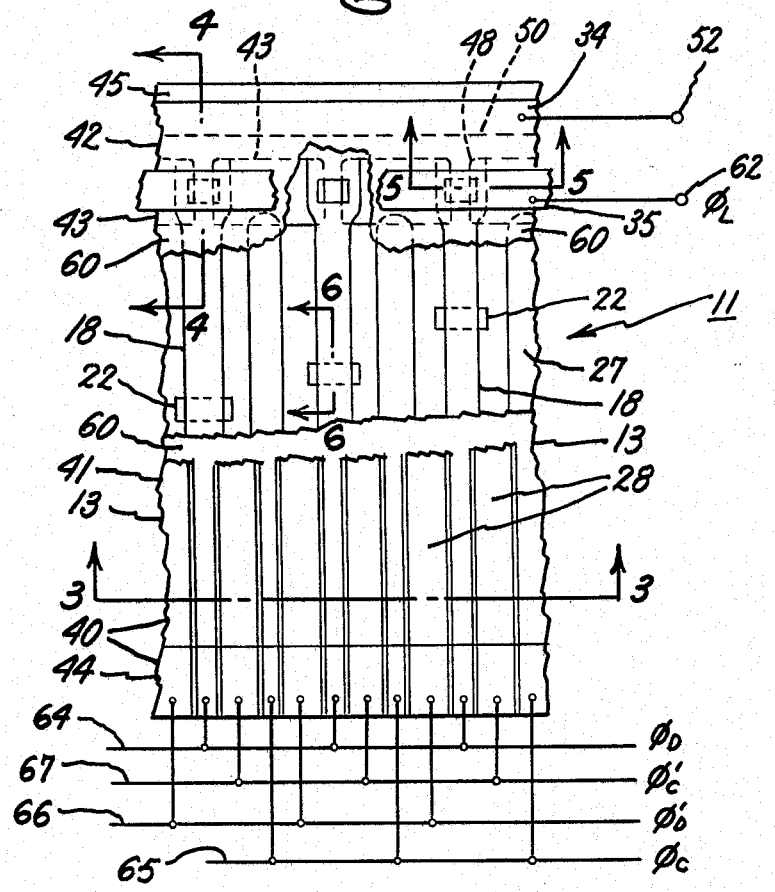
FIG. 2 shows a plan view of a detailed implementation of the analog multiplier of FIG. 1 in accordance with the present invention.
Figure 3:
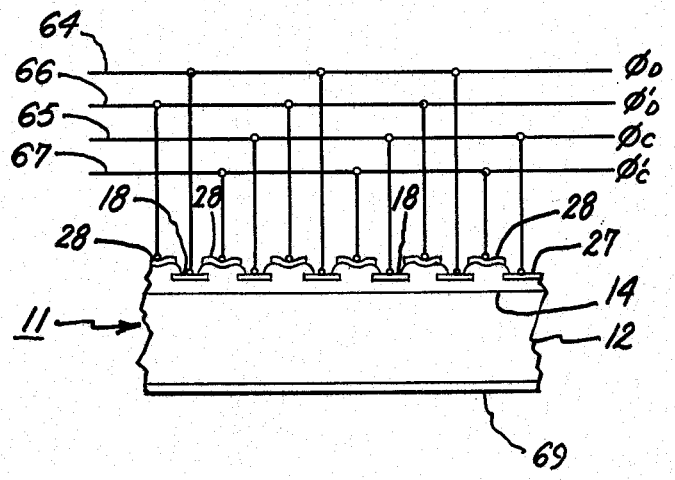
FIG. 3 is a sectional view of the embodiment of FIG. 2 taken along section lines 3—3 of FIG. 2.
Figure 4:
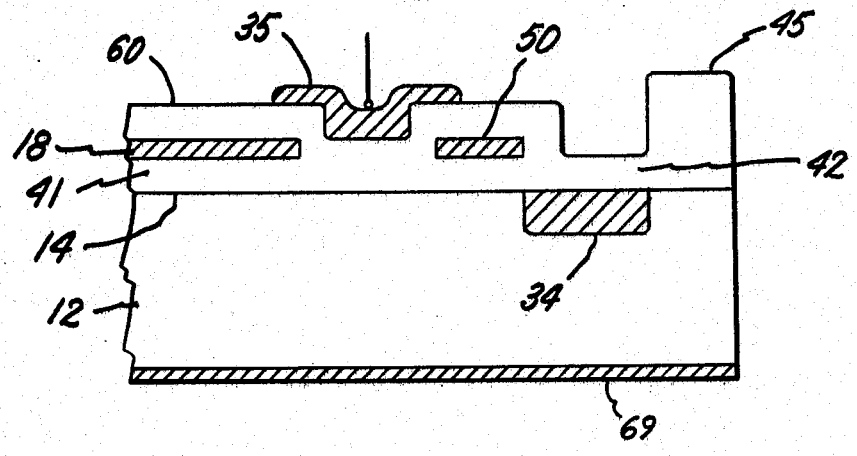
FIG. 4 is a sectional view of the embodiment of FIG. 2 taken along section lines 4—4 of FIG. 2.
Figure 5:
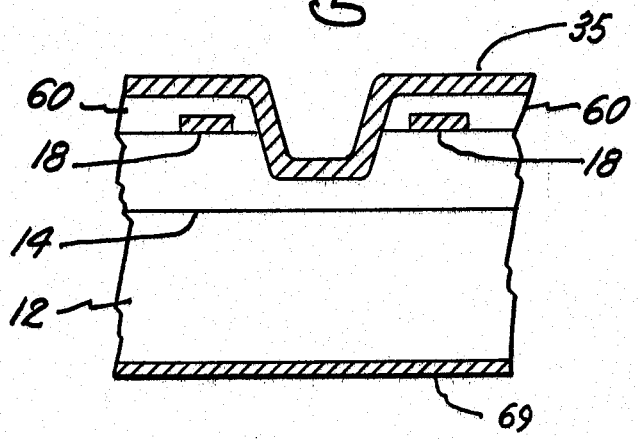
FIG. 5 is a sectional view of the apparatus of FIG. 2 taken along section lines 5—5 of FIG. 2.
Figure 6:
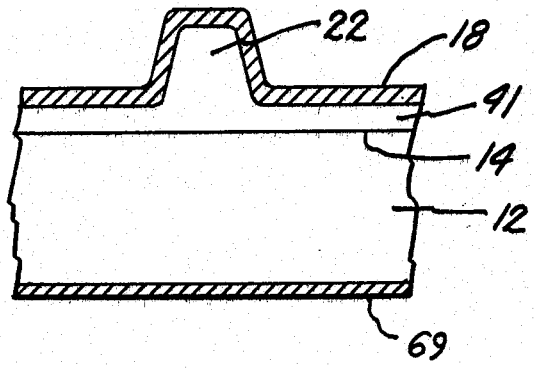
FIG. 6 is a sectional view of the apparatus of FIG. 2 taken along section lines 6—6 of FIG. 2.

The charge packets are transferred or clocked into appropriate cells 15 of each of the channels in same manner as in connection with the apparatus of FIGS. 1 and 2. The processing of the charge in the channels may be accomplished in several modes depending upon the bias voltage applied to the drain 34 from the variable drain voltage source 89 connected to common drain 34.

In one mode of operation, a bias voltage is applied to the drain 34 so as to substantially completely drain the charge introduced into the second storage regions 17 of channel A and also as to substantially completely drain the charge introduced in the first storage regions 16 of channel B. The altered packets of charge $Q_n^{A(out)}$ and $Q_n^{B(out)}$ in the two channels may be represented as follows:

$$Q_n^{A(out)} = (Q_n^{Sig} + Q_{bias}) \times \alpha_n \tag{8}$$

$$Q_n^{B(out)} = (-Q_n^{Sig} + Q_{bias}) \times \beta_n \tag{9}$$

When corresponding resultant output packets $Q_n^{A(out)}$ and $Q_n^{B(out)}$ are added in the combining channel C, the resultant output $Q_n^{out}$ may be represented as follows:

$$Q_n^{out} = Q_n^{Sig}(\alpha_{n-\beta n}) + Q_{bias}(\alpha_n + \beta_n)$$

As $$Q_{bias} = (\alpha_n + \beta_n)\, Q_{bias}, \text{ and}$$

setting the multiplying or weighting coefficient $w_n$ equal to $(\alpha_n - \beta_n)$ yields:

$$Q_n^{out} = Q_n^{Sig} w_n + Q_{bias} \tag{10}$$

The apparatus may also be operated in another mode, referred to as the equilibration mode. After the charge packets have been clocked into the storage cells in which the processing is to be carried out, the voltage of drain 34 is set to the same value as the bias voltage applied to the input circuits of channels A and B. The lateral transfer gates 35 and 81 are opened, and the charge in the second storage region of channel A and in the first charge storage region of channel B are allowed to equilibrate with the diffused region 34. After equilibration, each of the packets of charge in the second storage regions 17 of channel A equals $Q_{bias} \times \beta_n$ and each of the packets of charge in the first storage regions 16 of channel B equals $Q_{bias} \times \alpha_n$. After the lateral transfer gates 35 and 81 have been closed the resultant packets of charge obtained from channel A and channel B may be represented respectively as follows:

$$Q_n^{A(out)} = (Q_n^{Sig} + Q_{bias})\, \alpha_n + Q_{bias}\, \beta_n \tag{11}$$

$$Q_n^{B(out)} = (-Q_n^{Sig}\, Q_{bias})\, \beta_n + Q_{bias}\, \alpha_n \tag{12}$$

As corresponding packets of channels A and B are added in the combining channel C, the resultant output $Q_n^{out}$ may be represented as follows:

$$Q_n^{out} = Q_n^{A(out)} + Q_n^{B(out)}, \text{ or} \tag{13}$$

$$Q_n^{out} = Q_n^{Sig}(\alpha_n - \beta_n) + 2\, Q_{bias}(\alpha_n + \beta_n)$$

$$\text{As } w_n = (\alpha_n - \beta_n), \text{ and } Q_{bias}(\alpha_n + \beta_n) = Q_{bias},\ Q_n^{out} = Q_n^{Sig} w_n + 2\, Q_{bias}. \tag{14}$$

It should be noted that in both the first mode of operation and in the second mode of operation described above, the resultant output packet of charge is constituted of a fixed quantity of charge plus a quantity of charge representing the signal related charge multiplied by a weighting factor $w_n$. In the first mode of operation the fixed quantity of charge in a resultant output packet is simply the bias charge $Q_{bias}$ initially introduced into each of the channels. In the second mode of operation, the quantity of fixed charge in the resultant output packet is twice the bias charge $Q_{bias}$ initially introduced. If the voltage applied to the drain 34 is set at a value intermediate the value which completely drains the altered storage regions in channels A and B and the value which establishes charge in the altered storage regions equal to the component of initially introduced bias charge contained therein, then an output bias charge intermediate one and two times the initially introduced biased charge will result.

Figure 9:
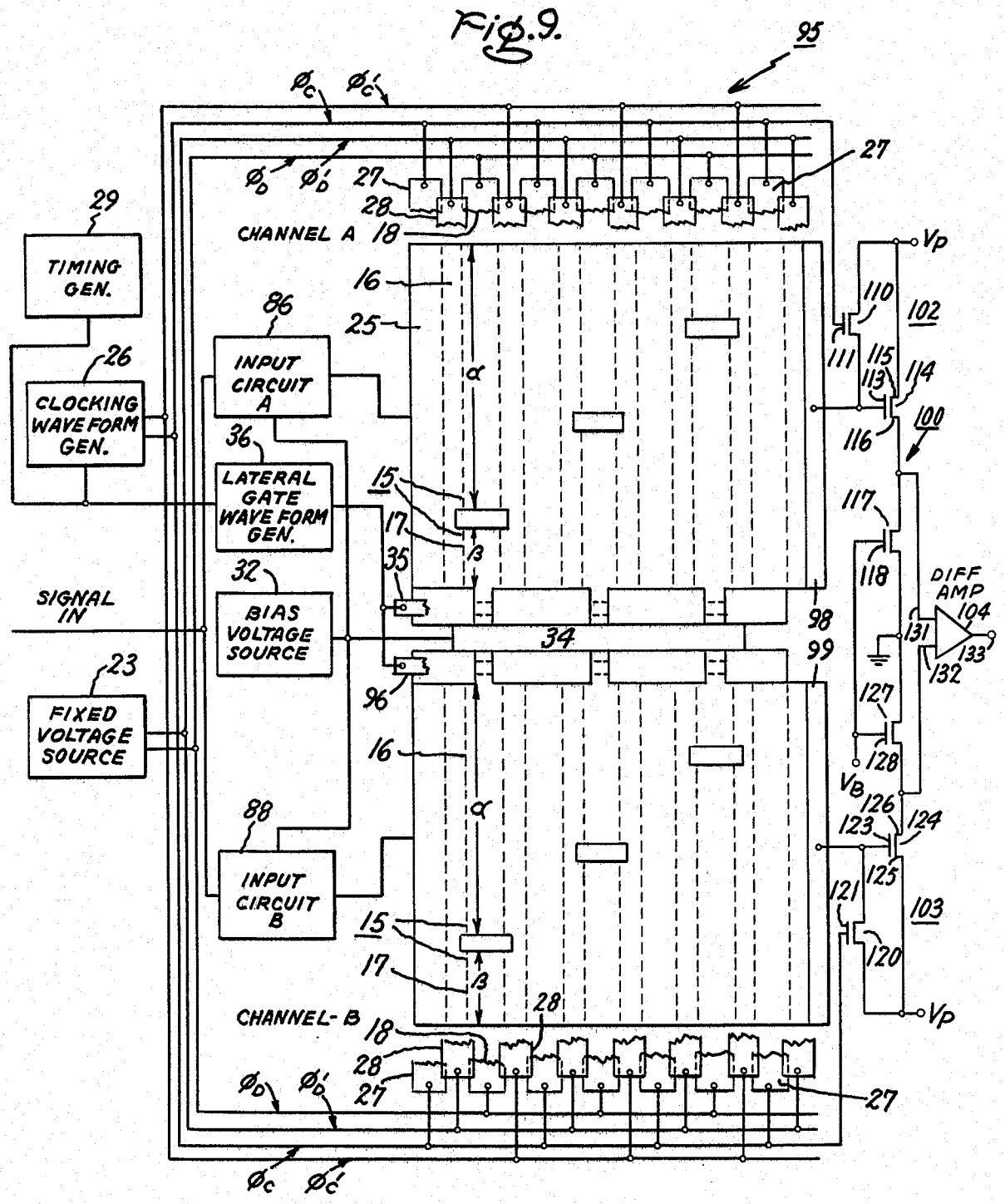
FIG. 9 is a diagram of analog multiplying apparatus in accordance with a further embodiment of the present invention.

Reference is now made to FIG. 9 which shows another four quadrant analog multiplier 95 in accordance with another feature of the present invention. The elements of the apparatus of FIG. 9 identical to the elements of the apparatus of FIG. 1 are identically designated. In this apparatus two shift registers or channels are provided, each essentially identically constituted and conveniently referred to as channels A and B. The storage electrodes 18 of channel A are conveniently referred to as first storage electrodes and storage electrodes of channel B are referred to as second stage electrodes. Channel A is identical to the shift register 11 of FIG. 1. Channel B is also identical to shift register 11 of FIG. 1 except that the lateral transfer gate 96 thereof is located to access the first storage regions 16 of the cells 15 of the channel instead of the second storage regions 17. Corresponding stages or cells 15 of channels A and B have the same ratio of width $\alpha$ of the first storage region 16 to width $\beta$ of the second storage region 17. A common lateral drain 34 is provided for channels A and B. The outputs of channels A and B are separately sensed and to this end an output diffused region 98 of conductivity type opposite to the conductivity type of the substrate is provided in the substrate adjacent the last $\phi_C$ electrode 27 of the channel A and another output diffused region 99 of opposite conductivity type is provided adjacent the last $\phi_C$ electrode 27 of the channel B. The lateral gate waveform generator 36 is controlled by the timing generator 29 and provides waveform $\phi_L$ (FIG. 7) to the lateral transfer gates 35 and 91. The clocking waveform generator 26 is identical to the clocking waveform generator 26 of FIG. 8 and provides the voltages for clocking the charge packets into channels A and B and, after processing operations have been performed in each of the stages on the packets, provides the voltage for clocking the resultant packets in channels A and B out to the respective output diffused regions 98 and 99. The same analog signals are applied to input circuit 86 of channel A and input circuit 88 of channel B. The same bias voltage is applied from bias voltage source 32 to the input circuits 88 and 89 and also to the lateral drain 34. Thus, the packet of the charge $Q_n^A$, the $n^{th}$ sample in a sequence of N samples, applied to the input of the channel A is the algebraic sum of a fixed quantity of bias charge $Q_{bias}$ and the signal related charge $Q_n^{Sig}$, and the packet of charge $Q_n^B$ applied to the input of the channel B is the algebraic sum of the same fixed quantity of bias charge applied to channel A and the same signal related charge $Q_n^{Sig}$. Thus, $$Q_n^A = Q_n^{Sig} + Q_{bias}, \tag{15}$$

and $$Q_n^B = Q_n^{Sig} + Q_{bias}. \tag{16}$$

The charge packets are transferred or clocked into appropriate cells 15 of each of the channels in same manner as in connection with the apparatus of FIGS. 1 and 2, and FIG. 8. The lateral transfer gates 35 and 96 are opened, and the charge in the second storage region 17 of channel A and the charge in the first charge storage region 16 of channel B are allowed to equilibrate with the diffused region 34. After equilibration, each packet of charge in the second storage regions 17 of channel A equals $Q_{bias} \times \beta_n$ and each packet of charge in the first storage regions 16 of channel B equals $Q_{bias} \times \alpha_n$. After equilibration the lateral transfer gates 35 and 96 are closed and the charge in each of the cells of channel A is sequentially clocked out to the output diffusion 98 of channel A to be sensed and the charge in each of the cells of channel B is clocked out sequentially to the output diffusion 99 of channel B to be sensed. The resultant packets of charge obtained from channel A and channel B may be represented, respectively, as follows:

$$Q_n^{A(out)} = (Q_n^{Sig} + Q_{bias})\,\alpha_n + Q_{bias}\,\beta_n \tag{17}$$

$$Q_n^{B(out)} = (Q_n^{Sig} + Q_{bias})\,\beta_n + Q_{bias}\,\beta_n \tag{18}$$

The outputs of channels A and B are separately sensed and the difference of the two outputs obtained by the differential output circuit 100 to provide the resultant output signal $Q_n^{out}$. Thus, $$Q_n^{out} = Q_n^{A(out)} - Q_n^{B(out)}, \tag{19}$$

or $$Q_n^{out} = Q_n^{Sig}(\alpha_n - \beta_n) \tag{20}$$

$$\text{As } w_n = (\alpha_n - \beta_n),\ Q_n^{out} = Q_n^{Sig}\, w_n. \tag{21}$$

The differential output circuit 100 includes precharge and float circuit 102 for channel A, precharge and float circuit 103 for channel B and differential amplifier 104. The precharge and float circuit 102 comprise a transistor 110 having its source to drain conduction path connected between the output diffused region 98 and a source of precharge potential $V_p$. The gate 11 of the transistor 110 is connected to the $\phi_C$ voltage line of source 26. The voltage $V_p$ is set to lie between the extreme values of the $\phi_C$ voltage waveform. Thus, when the $\phi_C$ storage sites of the shift register are receiving charge, the transistor 110 is turned on and a precharge voltage is applied to the output diffused region 98. During the next period of the clock cycle when the $\phi_C$ electrodes 27 are transmitting charge, the $\phi_C$ electrode adjacent the diffused region 98 rises in potential and enables charge to flow into the diffused region and alter the potential thereof in accordance with the magnitude of the charge transferred. The change in voltage on the diffused region 98 is applied to the gate 113 of transistor 114 connected as a source follower in which the drain 115 is connected to a suitable voltage source, for example, the source of voltage $V_p$, and the source electrode 116 of which is connected through the drain to source conduction path of transistor 117 to ground. The gate 117 of transistor 117 is connected to a suitable bias source of bias voltage $V_B$ to maintain substantially constant current flow in transistor 114. Thus, the gate to source potential difference of transistor 114 is maintained substantially constant as the voltage on gate 113 thereof varies in response to voltage sensed on diffused region 98, and the potential of source 116 follows the potential of the gate 113.

The precharge and float circuit 103 comprise a transistor 120 having its source to drain conduction 99 path connected between the output diffused region and a source of precharge potential $V_p$. The gate 121 of the transistor 120 is connected to the $\phi_C$ voltage line of source 26. The voltage $V_p$ is set to lie between the extreme values of the $\phi_C$ voltage waveform. Thus, when the $\phi_C$ storage sites of the shift register are receiving charge, the transistor 120 is turned on and a precharge voltage is applied to the output diffused region 99. During the next period of the clock cycle when the $\phi_C$ electrodes 27 are transmitting charge the $\phi_C$ electrode adjacent the diffused region 99 rises in potential and allows charge to flow into the diffused region and alter the potential thereof in accordance with the magnitude of the charge transferred. The change in voltage on the diffused region 99 is applied to the gate 123 of transistor 124 connected as a source follower in which the drain 125 is connected to a suitable voltage source, for example, the source of voltage $V_p$, and the source 126 of which is connected through the drain to source conduction path of transistor 127 to ground. The gate 128 of transistor 127 is connected to a suitable bias source of bias voltage $V_B$ to maintain substantially constant current flow in transistor 124. Thus, the gate to source potential difference of transistor 124 is maintained substantially constant as the voltage or gate 123 of transistor varies in response to voltage sensed on diffused region 99, and the source 126 follows the potential of the gate 123.

The output of channel A appearing at source 116 of transistor 114 is applied to one input terminal 131 of the differential amplifier 104 and the output of channel B appearing at source 126 of transistor 124 is applied to the other input terminal 132 of differential amplifier 104. The resultant output appearing at the output terminal 133 of differential amplifier is the difference in the packets of charge obtained from channels A and B and represented by equation 21. A particular advantage of the apparatus of FIG. 9 is apparent from equation 21 which does not include a fixed bias charge component. This signifies than in absence of signal no change in output voltage occurs. Another advantage of the apparatus of FIG. 9 is that clocking voltage feedthroughs are cancelled.

While in connection with the apparatus of FIGS. 8 and 9, channels A and B were shown having the same width and the storage cells were shown as having the same length in the direction of charge transfer, such structure is not necessary for operation of apparatus in accordance with the invention. The storage cells of channels A and B may have different overall widths. However, the ratio of widths of the first and second storage regions of a cell in one channel must be the same as the ratio of widths of the first and second storage regions of a corresponding cell in the other channel. Also it is essential that the same quantity of bias charge $Q_{bias}$ be applied to each of the channels.

While the invention has been described in embodiments employing serial structures, other system architectures may be employed, such as parallel structures, where the signal charge is introduced into the cells in a parallel manner.

While the invention has been described in specific embodiments in which a single phase clocking systems have been employed, it will be understood that other clocking systems such as multiphase clocking systems may as well be employed.

While the invention has been described in connection with apparatus constituted of N-type conductivity substrates, P-type conductivity substrates could as well be used. Of course, in such a case the applied potentials would be reversed in polarity.

While the invention has been described in specific embodiments, it will be understood that modifications, such as those described above may be made by those skilled in the art, and it is intended by the appended claims to cover all such modifications and changes as fall within the true spirit and scope of the invention.

What we claim as new and desire to secure by Letters Patent of the United States is:

1. Sampled data apparatus comprising a substrate of semiconductor material having a major surface, a plurality of first charge storage cells in said substrate adjacent said major surface forming a first channel, each cell including a first charge storage region and a second charge storage region, a plurality of first storage electrodes, each electrode associated with a respective cell, each electrode including a first part and a second part, each first part insulatingly overlying and coextensive with a respective first charge storage region and each second part insulatingly overlying and coextensive with a respective second charge storage region, the ratio of the width of the first charge storage region to the width of the second storage region of each of said cells being set to a respective one of a first sequential series of predetermined values, a first means for introducing into each of said first charge storage cells a respective first quantity of charge representing a respective sample of a signal, said quantity of charge being divided between the first and second storage regions of a cell in proportion to the ratio of the width of the first storage region to width of the second storage region thereof, a first means for altering the charge in each of the second storage regions of each of said first cells, a first means for recovering from each of said first charge storage cells a respective resultant quantity of charge stored therein, each resultant quantity being the sum of the initially introduced charge in the first storage region and the altered charge in the second storage region of a respective first cell.

2. The apparatus of claim 1, in which said first charge altering means removes substantially all of the charge from each of said second storage regions of said first cells.

3. The apparatus of claim 1 in which said first charge introducing means includes a plurality of third storage regions, each for introducing charge into a respective one of said first cells, and also includes means for simultaneously transferring charge from a third storage region into the first and second storage regions of an associated first cell, said transfer taking place in a direction substantially normal to the width dimension of said first and second storage regions of said first cells.

4. The apparatus of claim 3 in which said charge recovering means include a plurality of fourth storage regions, each for recovering charge from a respective one of said first cells and also includes means for jointly transferring charge from said first and second storage regions of a first cell to the fourth storage region associated therewith.

5. The apparatus of claim 4, in which said plurality of first cells and associated third and fourth charge storage regions are serially coupled to form a first plurality of stages of a charge coupled shift register, each stage including a first cell and associated third and fourth charge storage regions.

6. The apparatus of claim 5 including means during a first period of time for introducing in an initial cell of said shift register and thereafter serially transferring from stage to stage each of said first quantities of charge to a respective first cell of said shift register, means during a second period of time for inhibiting the transfer of charge from cell to cell in said shift register and for simultaneously altering the charge in each of the second storage regions of said first cells of said shift register, means during a third period of time for recovering in each of the fourth storage regions of the stages a respective resultant quantity of charge, means during a fourth period of time for serially transferring from stage to stage and for serially removing from the final stage of said shift register each of said resultant quantities of charge.

7. The apparatus of claim 5 in which the third storage region of one stage also functions as the fourth storage region of the preceding stage of the shift register.

8. The apparatus of claim 5, in which the ratio of the area of the first part of the area of the second part of each of said first storage electrodes is set equal to the ratio of the widths thereof, and in which the sum of the areas of the first and second parts of each of said first storage electrodes is a fixed value which is the same for each of said first storage electrodes.

9. The apparatus of claim 1 in which said first quantity of charge consists of the algebraic sum of a first fixed quantity of charge and a quantity of signal related charge, said signal related charge having both positive and negative values, and in which said first charge altering means changes the charge introduced into each of said second storage regions to be equal to the respective proportion of said first fixed quantity of charge introduced therein.

10. The apparatus of claim 1 in which said first quantity of charge consists of the algebraic sum of a first fixed quantity of charge and a quantity of signal related charge, said signal related charge having both positive and negative values, and in which is provided a plurality of second charge storage cells in said substrate adjacent said major surface forming a second channel, each cell including a first charge storage region and a second charge storage region, said second charge storage cells being equal in number to said first charge storage cells a plurality of second storage electrodes, each electrode associated with a respective second charge storage cell, each electrode including a first part and a second part, each first part insulatingly overlying and coextensive with a respective second charge storage region, the ratio of the width of the first charge storage region to the width of the second storage region of each of the said second charge storage cells being set equal to a respective one of a second sequential series of predetermined values, correspondingly situated values in said first and said second series being the same, second means for introducing into each of said second charge storage cells a respective second quantity of charge, said second quantity of charge consisting of the algebraic sum of a second fixed quantity of charge and a quantity of signal related charge which is the inverse of said signal related charge, means for recovering from each of said second charge storage cells a respective resultant quantity of charge stored therein, each resultant quantity being the sum of the initially introduced charge in the second storage region and the altered charge in the first storage region thereof, means for deriving signal samples each of which represents to the sum of the charge recovered from corresponding cells of said first and second channels of cells.

11. The apparatus of claim 10, in which a said first charge altering means changes the charge introduced into each of said second storage regions of said first cells to be equal to the respective proportion of said first fixed quantity of charge introduced therein, and in which said second charge altering means changes the charge introduced into each of said first storage regions of said second cells to be equal to the respective proportion of said second fixed quantity of charge introduced therein.

12. The apparatus of claim 11 in which said first fixed quantity of charge is equal to said second fixed quantity of charge.

13. The apparatus of claim 10 in which said first charge altering means removes substantially all of the charge from each of said second storage regions of said first cells, and in which said second charge altering means removes substantially all of the charge from each of said first storage regions of said second cells.

14. The apparatus of claim 10 wherein said means for deriving signal samples includes a common storage region into which charge from said first and second channels is transferred.

15. The apparatus of claim 1 in which said first quantity of charge consists of the algebraic sum of a first fixed quantity of charge and a quantity of signal related charge, said signal related charge having both positive and negative values, in which said first charge altering means changes the charge introduced into each of said second storage regions to be equal to the respective proportion of said first fixed quantity of charge introduced therein, and in which is provided a plurality of second charge storage cells in said substrate adjacent said major surface forming a second channel, each cell including a first charge storage region and a second charge storage region, a plurality of second storage electrodes, each electrode associated with a respective second charge storage cell, each electrode including a first part and a second part, each first part insulatingly overlying and coextensive with a respective first charge storage region and each second part insulatingly overlying and coextensive with a respective second charge storage region, the ratio of the width of the first charge storage region to the width of the second storage region of each of the said second charge storage cells being set equal to a respective one of a second sequential series of predetermined values, correspondingly situated values in said first and said series being the same, second means for introducing into each of said second charge storage cells a respective second quantity of charge, said second quantity of charge consisting of the algebraic sum of said first fixed quantity of charge and said quantity of signal related charge, said second charge altering means changing the charge introduced into each of said first storage regions to be equal to the respective proportion of said second fixed quantity of charge introduced therein, means for recovering from each of said second charge storage cells a respective resultant quantity of charge stored therein, each resultant quantity being the sum of the initially introduced charge in the second storage region and the altered charge in the first storage region thereof, means for deriving signal samples each of which represents to the difference of the charge recovered from corresponding cells of said first and second channels of cells.

* * * * *